US005692527A

United States Patent [19]

Matsumura et al.

[11] Patent Number: 5,692,527

[45] Date of Patent: Dec. 2, 1997

[54] TOBACCO SMOKE FILTER MATERIALS, FIBROUS CELLULOSE ESTERS, AND PRODUCTION PROCESSES

[75] Inventors: Hiroyuki Matsumura; Syu Shimamoto; Tohru Shibata, all of Himeji, Japan

[73] Assignee: Daicel Chemical Industries, Ltd., Sakai, Japan

[21] Appl. No.: 546,089

[22] Filed: Oct. 20, 1995

[30] Foreign Application Priority Data

Oct. 21, 1994 [JP] Japan ..... 6-282584

[51] Int. Cl.[6] ..... A24D 3/00

[52] U.S. Cl. ..... 131/345; 131/331

[58] Field of Search ..... 131/331, 332, 131/345; 428/364, 369, 400, 401

[56] References Cited

U.S. PATENT DOCUMENTS 5,150,723 9/1992 Lee et al. ..... 131/345 X
5,509,430 4/1996 Berger ..... 131/345 X

FOREIGN PATENT DOCUMENTS 50-38720 12/1975 Japan .
52-96208 8/1977 Japan .
53-45468 4/1978 Japan .

*Primary Examiner*—Jennifer Bahr
*Attorney, Agent, or Firm*—Cushman Darby & Cushman IP Group of Pillsbury Madison & Sutro, LLP

[57] ABSTRACT

A tobacco smoke filter material has a fibrillated cellulose ester fiber with an average fiber diameter of 15 to 250 μm and a BET specific surface area of 0.5 to 4.5 $m^2/g$. The fibrous cellulose ester content of the material may for example be not less than 20 weight %. The cellulose ester fiber is provided by, for example, extruding a cellulose ester solution from a nozzle into a precipitating agent for the particular cellulose ester and subjecting the extrudate to a shear force. This filter material can be used in the form of, for example, a filament, web or sheet to provide a tobacco smoke filter which assures good smoking qualities and excellent wet disintegratability.

13 Claims, 2 Drawing Sheets

TOBACCO SMOKE FILTER MATERIALS, FIBROUS CELLULOSE ESTERS, AND PRODUCTION PROCESSES

FIELD OF THE INVENTION

This invention relates to a tobacco smoke filter material with improved wet disintegratability, a cellulose ester fiber for use in the material, a process for producing the fiber, and a tobacco smoke filter as produced using the material and featuring good smoking qualities and improved wet disintegratability.

BACKGROUND OF THE INVENTION

As the tobacco smoke filter designed to remove the tar component of tobacco smokes and yet offer a satisfactory smoking quality, a filter plug fabricated by molding a cellulose acetate fiber bundle with the aid of a plasticizer such as triacetin is in broad use. However, because the monofilaments in the bundle are partially fused to one another by the plasticizer, it takes a long time for this filter plug to disintegrate itself in the environment after being discarded after use and, thus, add to the pollution problem.

Meanwhile, a paper-based tobacco smoke filter made from a creped wood pulp sheet and a tobacco smoke filter comprising a regenerated cellulose fiber bundle are also known. Compared with the filter plug comprising a cellulose acetate tow (fiber bundle), these filters are somewhat greater in wet disintegratability so that the pollution problem can be mitigated to some extent. However, these filters are not only inferior in terms of smoking qualities but, compared with a cellulose acetate filter, significantly low in the selective elimination for phenols which is essential to any tobacco filter. Moreover, with a given pressure loss, the above filters are lower in hardness.

Japanese Patent Application Laid-open No. 96208/1977 (JP-A-52-96208) discloses a sheet comprising a cellulose acetate pulp prepared by a specified technology and short staples of a thermoplastic resin. Because this sheet is prepared by mix-webbing the pulp and short staples into a paper form and pressing the web under heating, it is large in tensile strength and elongation after immersion in water, high in water resistance, and extremely poor in disintegratability.

Japanese Patent Publication No. 38720/1975 (JP-B-50-38720 discloses a tobacco smoke filter comprising a fibrous artifact with a surface area of not less than 3 $m^2/g$, which fibrous artifact is composed of fibrillated cellulose acetate microfibers with a diameter of 0.1 to 10 μm. However, since this fibrous artifact has been highly fibrillated, the interfilament adhesion is great enough to provide for high strength but is hardly disintegratable. Moreover, since the filter has a large surface area, the efficiency of elimination of harmful components from the tobacco smoke is high but as the aromatic component is also removed, the smoking quality is rather sacrificed.

Japanese Patent Application Laid-open No. 45468/1978 (JP-A-53-45468) discloses a filter material comprising a nonwoven fiber sheet containing 5 to 35% by weight of cellulose ester fibril with a diameter of 0.5 to 50 μm and a surface area of not less than 5 $m^2/g$ and 65 to 95% by weight of cellulose ester short staples. However, since the cellulose ester fibril has been highly fibrillated, the disintegratability of this filter material is also insufficient to alleviate the pollution problem and, moreover, the filter tends to detract from the smoking quality (aroma, taste and palatability) of tobacco.

SUMMARY OF THE INVENTION

It is, therefore, an object of this invention to provide a tobacco smoke filter material which does not interfere with the aroma, taste and palatability of leaf tobacco and has a sufficiently high wet disintegratability to reduce the risk of pollution.

It is another object of this invention to provide a tobacco smoke filter material which is high in dry strength and yet disintegrates itself rapidly under wet conditions.

It is a further object of this invention to provide a tobacco smoke filter material which removes harmful components of the tobacco smoke with high efficiency and yet without interfering with the smoking quality of the tobacco.

It is still another object of this invention to provide a cellulose ester fiber for use in the tobacco smoke filter material having excellent characteristics as above and a process for producing the fiber.

Another yet object of this invention is to provide a tobacco smoke filter having the above-mentioned excellent characteristics.

The inventors of this invention found after a series of intensive research for accomplishing the above objects that a tobacco smoke filter material containing a cellulose ester fiber having a larger diameter and a smaller specific surface area than the conventional highly fibrillated microfiber is not only superior in terms of smoking quality and in the efficiency of elimination of harmful components from the tobacco smoke but is easily or readily disintegrated by rain-water or others in the environment. This invention has been developed on the basis of the above finding.

Thus, the fibrous cellulose ester of this invention is a fibrillated cellulose ester fiber having an average diameter of 15 to 250 μm and a BET specific surface area of 0.5 to 4.5 $m^2/g$. The tobacco smoke filter material of this invention comprises the fibrous cellulose ester. The proportion of the fibrous cellulose ester in the material can be liberally selected from a broad range and may for example be not less than 20% by weight based on the total weight of the material. The cellulose ester mentioned above typically includes various esters of cellulose with organic acids containing 2 to 4 carbon atoms. The filter material may for example be a sheet having the paper web structure and may have been creped or embossed. The tobacco smoke filter of this invention comprises the tobacco smoke filter material.

The fibrous cellulose ester mentioned above can be obtained by, for example, extruding a cellulose ester solution from a nozzle in a precipitating agent (a non-solvent or a poor solvent) for the cellulose ester and subjecting the extrudate to shear forces.

The term "sheet" as used in this specification means a two-dimensional paper-like artifact which can be taken up in a roll form. The term "average diameter" means the average value of measured diameters of individual monofilaments in wet condition. When the monofilament is highly branched, the diameter of its most solid portion is regarded as the diameter of the same monofilament.

DETAILED DESCRIPTION OF THE INVENTION

Figure 1:
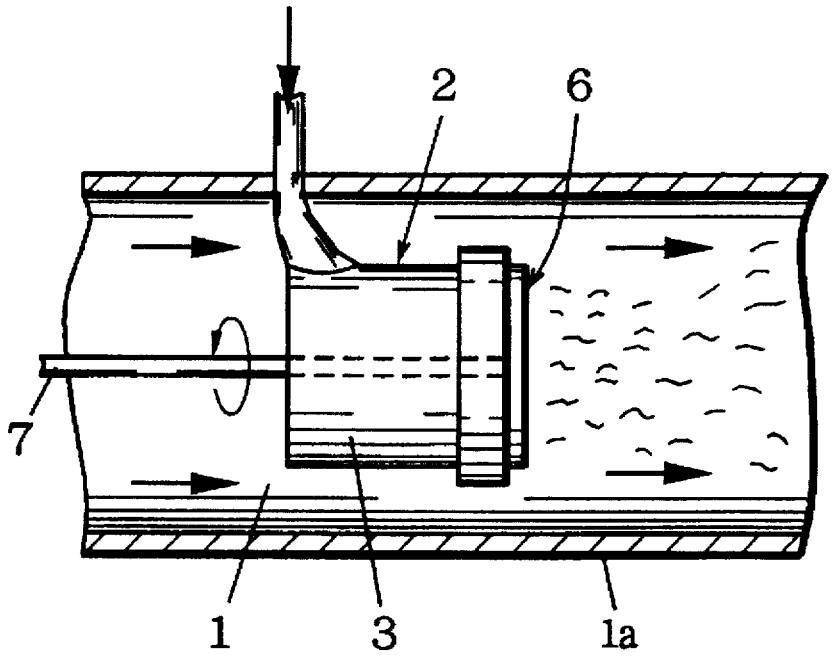
FIG. 1 is a schematic cross-section view showing an exemplary equipment that can be used in the manufacturing process of this invention.

The cellulose ester mentioned above includes but is not limited to organic acid esters of cellulose such as cellulose acetate, cellulose butyrate, cellulose propionate, etc.; inorganic acid esters of cellulose such as cellulose nitrate, cellulose sulfate, cellulose phosphate, etc.; mixed acid esters of cellulose such as cellulose acetate propionate, cellulose acetate butyrate, cellulose acetate phthalate, cellulose nitrate acetate, etc.; and cellulose ester derivatives such as polycaprolactone grafted cellulose acetate, and so on. These cellulose esters can be used singly or in combination. The fibrous cellulose ester of this invention may contain other substances in addition to such cellulose ester or esters. However, the cellulose ester content of the fiber is preferably not less than 50% by weight based on the total weight of the fibrous cellulose ester.

The average degree of polymerization of the cellulose ester may for example be about 10 to 1,000, preferably about 50 to 900, and for still better results, about 200 to 800, and the average degree of substitution of the cellulose ester may for example be about 1 to 3 (e.g. about 1 to 2.7). The cellulose ester with an average degree of substitution in the range of about 1 to 2.15, preferably about 1.1 to 2.0, is useful for enhanced biodegradability.

These is no particular limitation on the raw material for the cellulose ester. Thus, natural cellulose, regenerated cellulose, etc. can all be employed. Generally, wood pulp is practically used. Although a cellulose with high purity is preferred as the raw material for the cellulose ester, this invention is characterized in that a cellulose material of low quality grade (e.g. a wood pulp with a hemicellulose content of about 5 to 20% by weight) can also be effectively utilized.

The cellulose ester in which the equivalent ratio of residual alkali metal or alkaline earth metal to residual sulfuric acid is about 0.1 to 1.5, preferably about 0.3 to 1.3 (e.g. about 0.5 to 1.1), is not only highly heat-resistant but also highly biodegradable. The residual sulfuric acid mentioned above is derived from the sulfuric acid used as a catalyst in the production of the cellulose ester and may be in the form of free sulfuric acid, its salt, sulfoacetate or sulfuric acid ester that may remain in the cellulose ester. The alkali metal (e.g. lithium, sodium or potassium) or alkaline earth metal (e.g. magnesium, calcium, strontium or barium) is added not only as a neutralizing agent for the sulfuric acid catalyst but also for improving the heat resistance of the cellulose ester.

The preferred cellulose ester includes organic acid esters (e.g. esters with organic acids having about 2 to 4 carbon atoms), particularly cellulose acetate. While the amount of acetic acid bound in the cellulose acetate (the degree of acetylation) is generally about 43 to 62%, a cellulose acetate with a degree of acetylation in the range of about 29 to 52%, preferably about 31 to 49%, is very satisfactory in biodegradability. Therefore, the degree of acetylation of the cellulose acetate can be selected within the range of about 29 to 62%.

The morphology of the cellulose ester is fibrous. Moreover, the fiber may be close to being of indefinite shape, i.e. branched to a high order. The average diameter of the cellulose ester fiber is about 15 to 250 μm (e.g. about 20 to 200 μm), preferably about 20 to 200 μm, and for still better results, about 30 to 150 μm. If the average diameter is less than 15 μm, the strength of the material will be insufficient. On the other hand, if the average diameter exceeds 250 μm, the moldability tends to be sacrificed. The fiber length of the fibrous cellulose ester can be liberally selected from the range which does not adversely affect the strength and moldability of the material and is generally about 0.1 to 10 mm and preferably about 0.2 to 5 mm.

There is no particular limitation on the sectional configuration of the fibrous cellulose ester. Thus, it may be round (circular), elliptical (oval) or irregular (modified) (e.g. Y-, X-, R- or I-shaped) and even annular (hollow). The cellulose ester fiber may have been crimped, if necessary.

The fibrous cellulose ester has been fibrillated and its specific surface area as measured by the BET method (hereinafter referred to as BET specific surface area) is about 0.5 to 4.5 $m^2/g$, preferably about 0.5 to 4 $m^2/g$ (i.e. 1 to 3 $m^2/g$), and in many instances, about 0.7 to 3.8 $m^2/g$ (i.e. 0.7 to 3.5 $m^2/g$). If the BET specific surface area is less than 0.5 $m^2/g$, the efficiency of elimination of harmful components from the tobacco smoke will be insufficient. Conversely if the limit of 4.5 $m^2/g$ is exceeded, the aromatic or flavor components of tobacco are also removed at the same time to detract from the smoking quality of the tobacco.

Unlike the non-fibrillated short staples and highly fibrillated microfine fibers, the fibrillated cellulose ester fiber having the above-defined average diameter and BET specific surface area is excellent in wet disintegratability despite its high strength, thus satisfying both strength and disintegratability requirements. Moreover, having an adequate filtration efficiency, this fiber provides for efficient elimination of harmful components without sacrificing the aroma, taste and palatability of tobacco smoke.

The fibrous cellulose ester mentioned above can be prepared by, for example, extruding a cellulose ester solution or dope from a nozzle into a precipitating agent or medium (hereinafter referred to sometimes as a coagulation agent or a poor solvent) for the cellulose ester and allowing shear forces to act on the extrudate. The cellulose ester solution extruded from the nozzle on coming into contact with the precipitating agent (coagulation agent) begins to coagulate from its peripheral surface. In this process, shear forces are caused to act on the cellulose ester solution (spinning dope) so extruded to partially fibrillate and cut the uncoagulated tow or fiber to provide a fibrillated cellulose ester fiber having the above-specified average diameter and BET specific surface area. When the spinning dope shaped into a fibrous form is coagulated in the above manner with the use of a nozzle, the fibrous cellulose ester of the present invention can be produced with good efficiency. However, the production technology for the fibrous cellulose ester is not restricted to the above procedure. All that is necessary is to cause a shearing force to act upon the cellulose ester extrudate while it is coagulated.

The production technology of this invention is now described in detail, referring to the accompanying drawings wherever necessary.

For practicing the process of this invention, various types of equipments can be employed only if the spinning dope can be extruded and at the same time subjected to a shear force. In many cases, such an equipment comprises a conduit (passage) supplied with a coagulation fluid, a nozzle means adapted to deliver a cellulose ester solution (hereinafter referred to sometimes as a spinning dope) into the conduit, and a cutter means for cutting the fibrous spinning dope extruded from the nozzle means.

Figure 2:
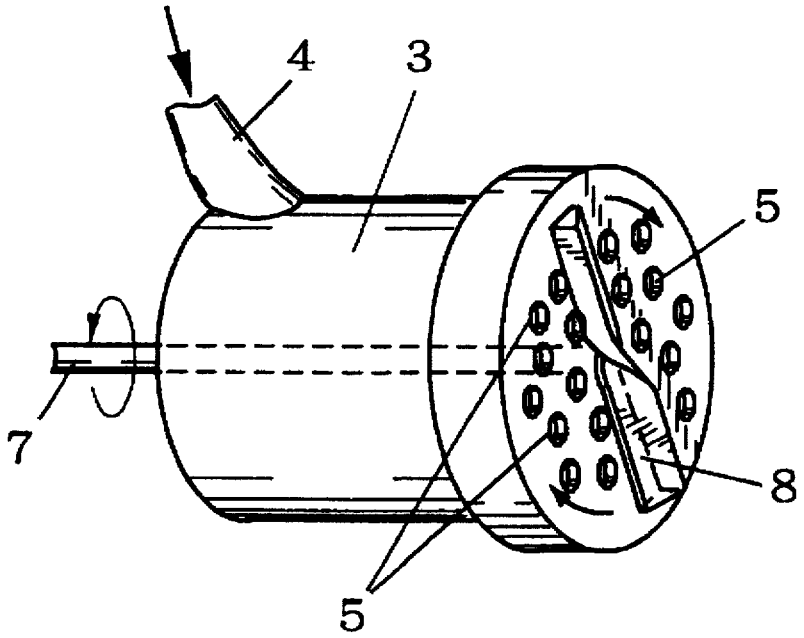
FIG. 2 is a schematic perspective view of the nozzle means of the equipment illustrated in FIG. 1.

FIG. 1 is a schematic diagram showing a typical equipment that can be utilized in practicing the process of this invention and FIG. 2 is a schematic perspective view of the nozzle means of the equipment shown in FIG. 1.

The equipment illustrated in FIGS. 1 and 2 comprises a conduit 1 defined by the circumferential wall of a pipe 1*a* for supply of the coagulation fluid, a nozzle means 2 disposed in the conduit 1 for delivering a spinning dope into the conduit, and a cutting means 6 by which the spinning dope extruded in the form of a fiber from the nozzle means is cut under shear forces.

The nozzle means 2 comprises a cylindrical casing 3 equipped with a feeder (supply port) 4 for supplying a spinning dope and a plurality of orifices 5 formed in the downstream end wall of the casing 3. The cutting means 6 comprises a shaft 7 extending axially within the casing 3 and a cutter 8 mounted at the forward end of the shaft and rotatable by a rotary drive means such as an electric motor. The cutter 8 of the cutting means 6 is rotatable in sliding relation or geometric proximity with the circumferential wall of the pipe 1*a* into which the spinning dope is extruded.

With the above equipment, the spinning dope supplied under pressure from the feeder 4 into the cylindrical casing 3 is extruded from the orifices 5 of the nozzle means 2. The spinning dope extruded in a fibrous form from the orifices 5 is cut by the cutter 8 of the cutting means 6 and, at the same time, comes into contact with the coagulation fluid supplied into the conduit 1. The rotational and agitating forces of the revolving cutter 8 shear the fibrous spinning dope emerging from the orifices 5 so that the extruded fibrous spinning dope is cut into (coagrated) short staples and, concurrently, partially fibrillated.

Figure 3:
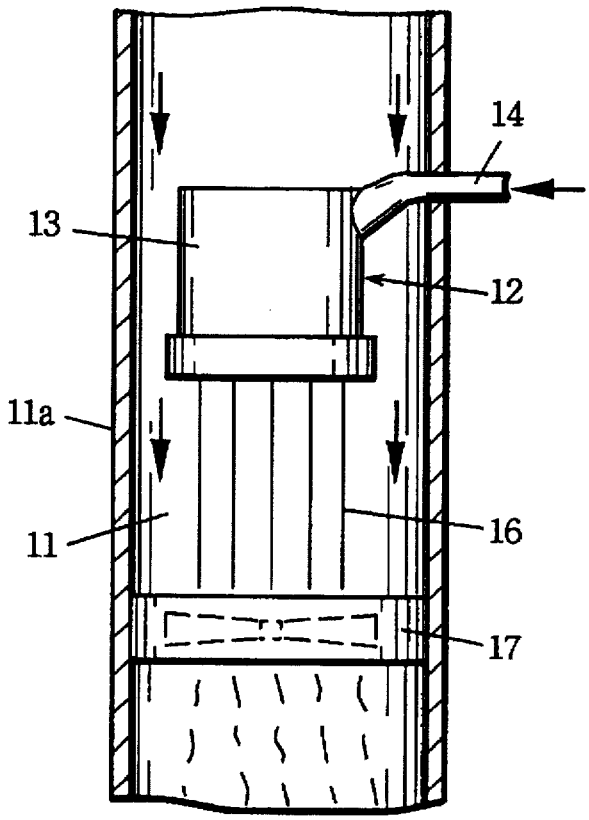
FIG. 3 is a schematic cross-section view showing another exemplary equipment for use in the manufacturing process of this invention.
Figure 4:
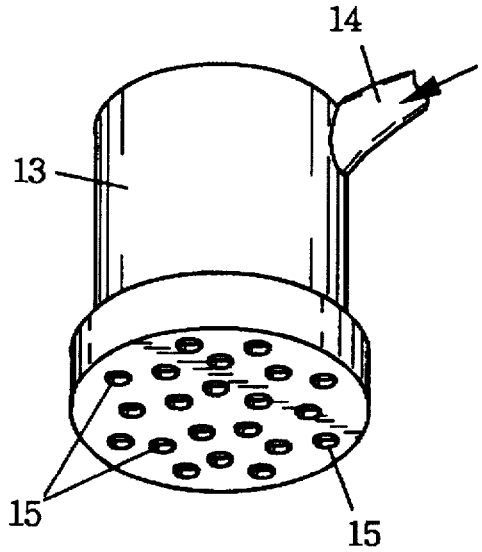
FIG. 4 is a schematic perspective view of the nozzle means of the equipment illustrated in FIG. 3.

FIG. 3 is a schematic diagram showing another exemplary manufacturing equipment that can be employed for practicing the process of this invention and FIG. 4 is a schematic perspective view of the nozzle means of the equipment shown in FIG. 3.

The equipment illustrated in FIGS. 3 and 4 comprises a conduit 11 defined by the circumferential wall of a pipe 11*a* and supplied with a coagulation fluid, a nozzle means 12 disposed within the conduit 11 for delivering a spinning dope into the conduit, and a cutting means 17 by which the spinning dope extruded in the form of a fiber from the nozzle means is cut under the shearing forces of the whirling (spiral) flow caused by the cutting means.

The above nozzle means 12 also comprises a cylindrical casing 13 equipped with a feeder (supply port) 14 and a plurality of orifices 15 formed in the discharge end wall of the casing on the downstream side of the conduit 11. The spinning dope supplied under pressure from the feeder 14 into the casing 13 is extruded from the orifices 15 of the nozzle means 12 and the resulting spinning dope in the form of a fiber 16 contacts the coagulation fluid in the conduit 11.

In order to cut the uncoagulated fibrous spinning dope under a shearing force, there is provided a cutting means 17 equipped with a rotary cutter of the impeller type disposed rotatably, apart from and on the downstream side of the discharge end wall having the orifices 15 within the conduit 11. With this equipment, the fibrous spinning dope 16 extruded from the orifices 15 begins to be coagulated by the coagulation fluid and, concurrently, shorn by the spiral flow created by the rotational and agitating forces of the revolving cutter of the cutting means 17. Therefore, the fibrous spinning dope 16 is shorn into short staples and, at the same time, partially fibrillated while it undergoes coagulation.

The cutter of the cutting means may be disposed so as to be rotatable in close proximity of the discharge end wall of the casing or at a short distance from the discharge end wall. Moreover, the degree of fibrillation and the length of staple fiber can be controlled by varying the extrusion speed of the spinning dope, the distance between the discharge end wall and the cutting means, and the magnitude of shear force applied by the cutting means (the rotational speed of the cutter), among other factors. The shear force need only be applied before the spinning dope has been completely coagulated and may be allowed to act on the partially coagulated spinning dope. The shear force to be applied is not limited to the rotary shearing force of the cutter or the impeller vane-generated swirling or spiral flow but may be the force of a jet current or the impact force of pulse waves.

The magnitude of shear force can be selected from a suitable range according to the species of the raw material and other factors. Such shear force can be obtained, for example, by rotating a cutter of a diameter of 8 cm at a rate of 1,000 to 10,000 rpm, and preferably about 1,500 to 5,000 rpm.

When a circular-orifice nozzle is employed, the orifice diameter can be suitably selected according to the desired monofilament diameter but is generally about 10 to 1000 μm. The nozzle need not be a circular-orifice nozzle as illustrated but can be a nozzle equipped with a non-circular orifice having a sectional area generally equal to that of the circular-orifice nozzle.

The cellulose ester solution or dope can be prepared by dissolving the cellulose ester in a good solvent. The good solvent can be adequately selected according to the type and average substitution degree of cellulose ester. Thus, the good solvent that can be used includes various organic solvents, e.g. ketones such as acetone, methyl ethyl ketone, etc., ethers such as dioxane, carboxylic acids such as acetic acid, esters such as methyl acetate, ethyl acetate, methyl cellosolve acetate and ethyl cellosolve acetate, halogenated alkanes such as dichloromethane, various mixtures of such organic solvents, and a mixed solvent comprising any of such organic solvents and an alcohol such as methanol or water. The good solvent that can be most generally employed includes acetone, methyl ethyl ketone, dioxane, acetic acid and mixed solvents such as dichloromethane-methanol, acetone-water, and acetic acid-water. The cellulose ester solution can be the dope prepared by esterifying the starting material cellulose in a solvent and, if necessary, hydrolyzing the ester.

The concentration of the cellulose ester in the cellulose ester solution or dope is generally about 2 to 50% by weight, preferably about 5 to 40% by weight, and, for still better results, about 10 to 25% by weight. If the concentration is less than 2% by weight, the cellulose ester fiber cannot be produced with good efficiency. On the other hand, if the concentration exceeds 50% by weight, the viscosity of the solution will be too high to obtain a fiber of desired shape.

The coagulation fluid (coagulation agent) can be selected from among non-solvents or poor solvents for cellulose esters according to the kind of cellulose ester and that of good solvent used. For example, water, alcohols such as methanol, and mixtures of water with the good solvents can be mentioned. The coagulation fluid generally includes water, methanol, acetone-water, dioxane-water, and acetic acid-water, among others. Any mixture solvent for use as the coagulation fluid is richer in water than the mixture solvent for use as the good solvent.

There is substantially no limitation on the combination of the good solvent and the coagulation fluid, but taking cellulose acetate as an example, the following combinations can be suggested as examples.

(i) Cellulose diacetate with an average substitution degree of about 2.5

(a) Good solvent: acetone, ≧70 wt. % acetone-water Coagulation fluid: water, or ≦50 wt. % acetone-water (b) Good solvent: dioxane Coagulation fluid: water, or ≦30 wt. % dioxane-water (c) Good solvent: acetic acid, or 60 wt. % acetic acid-water Coagulation fluid: water, or ≦40 wt. % acetic acid water (ii) Cellulose triacetate with an average substitution degree of about 3

(d) Good solvent: methylene chloride-methanol=9/1 (by weight) Coagulation fluid: methanol The ratio of the coagulation fluid to the cellulose ester solution can be suitably selected within the range not adversely affecting the characteristics of the product fiber but is generally such that the former/the latter is not less than about 10/1 (by weight), for example about 30/1 to 200/1 (by weight).

The fibrillated cellulose ester fibrous article obtained by the above method is not sufficiently free of the solvent and, hence, high in the degree of swelling so that if allowed to dry as it is, it tends to give a hard resinous product. Therefore, it is preferable that the fibrous article be dehydrated, rinsed with warm or cold water, and treated in the presence of water such as boiling water or steam. These treatments lower the degree of swelling and the subsequent drying gives a soft flocculent or plumous fiber. The boiling water treatment or water vapor treatment (steaming) time is generally not less than 5 minutes (e.g. about 10 min. to 2 hr.) and preferably about 10 to 50 minutes.

The filter material of this invention comprises the fibrous cellulose ester. The fibrous cellulose ester content of the filter material can be selected according to the desired strength and disintegratability of the material and may for example be not less than 20 weight % (e.g. about 30 to 100 weight %), preferably not less than 40 weight % (e.g. about 50 to 100 weight based on the total weight of the material. In many instances the filter material comprises at least 60 weight % of the cellulose ester fiber. If the cellulose ester fiber content is less than 20 weight %, the smoking quality of tobacco tends to be sacrificed. The filter material of this invention is characterized in that, even in the absence of other components, it shows an adequate tobacco smoke filtration efficiency and provides for a filter assuring a satisfactory aroma, taste and palatability of the smoke and a high degree of wet disintegratability.

Where necessary, however, the filter material of this invention may contain other substances (hereinafter referred to as the secondary component), for example synthetic polymers such as polyolefins (e.g. polyethylene, polypropylene, etc.), poly(vinyl alcohol), polyesters (e.g. polyethylene terephthalate) and polyamides; natural celluloses derived from wood fibers (e.g. soft wood pulp, hard wood pulp, etc.), seed fibers (cotton such as linter, bombax cotton, kapok, etc.), bast fibers (e.g. hemp, linen, jute, ramie, paper mulberry, paper bush (mitsumata), etc.), and leaf fibers (e.g. Manila hemp, New Zealand flax, etc.); and regenerated celluloses such as viscose rayon, cuprammonium rayon, Fortisan, nitrate rayon, etc. Among these examples of the secondary component, natural cellulose (particularly wood pulp and linter pulp) and regenerated cellulose are useful for enhanced biodegradability of the material.

The morphology of the secondary component is not critical but is practically particulate (especially powdery) or fibrous. When the secondary component is used in a fibrous form, the moldability, particularly sheet-forming property, of the material is improved.

The ratio of the cellulose ester fiber to the secondary component can be adequately selected within the range not sacrificing the smoking quality and wet disintegratability of the filter but is generally such that the former/the latter is 98/2 through 20/80 by weight, preferably 95/5 through 30/70 by weight, and for still better results, about 90/10 through 50/50 by weight.

The above-mentioned cellulose ester and filter material may contain a variety of additives within the range not adversely affecting their characteristics. Among such additives are various sizing agents including finely divided inorganic substances such as powders of kaolin, talc, diatomaceous earth, titanium dioxide, alumina, quartz, calcium carbonate, barium sulfate, etc.; thermal stabilizers such as salts of the alkali metals and alkaline earth metals mentioned hereinbefore; colorants; yield improvers; and so forth. Moreover, incorporation of a biodegradation accelerator such as citric acid, tartaric acid, malic acid or the like and/or a photodegradation accelerator such as anatase titanium dioxide provides for enhanced degradability as well as high disintegratability as above.

The filter material may contain a plasticizer such as triacetin or triethylene glycol diacetate within the range not sacrificing the disintegratability, but in order to insure high wet disintegratability, it preferably does not contain a plasticizer. Where necessary, the filter material may contain an adhesive, too. However, in order to provide for high wet disintegratability, the adhesive if used is preferably a water-soluble adhesive. The water-soluble adhesive includes but is not limited to natural adhesives (e.g. starch, modified starch, solubilized starch, dextran, gum arabic, sodium alginate, casein, gelatin, etc.); cellulose derivatives (e.g. carboxymethylcellulose, hydroxyethylcellulose, methylcellulose, ethylcellulose, etc.), and synthetic resin adhesives (e.g. poly(vinyl alcohol), polyvinylpyrrolidone, poly(vinyl ether), water-soluble acrylic resin, poly(vinyl acetate), vinyl alkyl ether-maleic acid copolymer, poly (alkylene oxide), water-soluble polyester, water-soluble polyamide, etc.). These water-soluble adhesives can be used singly or in combination.

The morphology (shape) of the material is not critical but includes a filament, a floc, a woven fabric, a nonwoven fabric, a tow (fiber bundle), a web, or a sheet. The preferred material is a web or a sheet, particularly a nonwoven sheet having the paper web structure. The term "paper web structure" is used herein to mean a structure in which individual fibers are intertwined or entangled. Such a material is characterized by high paper strength and yet disintegrates itself rapidly on wetting by rainwater or the like.

The above-mentioned filter material can be manufactured by, for example, (1) the process which comprises using as intact, or molding a fibrous cellulose ester-containing composition directly into a filter material or (2) the process which comprises sheeting a fibrous cellulose ester-containing composition. In the first-mentioned process, if an adhesive is required, the above-mentioned water-soluble adhesive is preferably used so as not to interfere with wet disintegratability. The second-mentioned sheet material can be obtained by (a) wet-webbing a fibrous cellulose ester-containing slurry on a paper machine or (b) dry-webbing a fibrous cellulose ester-containing composition.

The solids content of the above-mentioned slurry for use in the wet-webbing process (a) can be liberally selected within the range permitting web formation and may for example be about 0.005 to 0.5 weight %. The wet-webbing can be achieved by the conventional procedure, for example by wet-webbing on a paper machine equipped with a porous plate (perforated plate) and subjecting the wet web to dehydration and drying.

The dry webbing (b) can also be performed by the conventional procedure, for example by spraying the above-mentioned composition against a net by means of an air jet (air flow). Where an adhesive is used in dry webbing, a water-soluble adhesive, such as those mentioned above, is preferably employed. The material prepared with the aid of such a water-soluble adhesive is highly disintegratable, breaking up into individual fibers when wetted.

Whereas the sheet manufactured by the conventional thermal pressure forming method utilizing the thermoplastic property of cellulose esters suffers a considerable loss of wet disintegratability, the filter material obtained by the above technology of the invention retains high wet disintegratability.

The tobacco smoke filter material of the present invention is useful for the manufacture of a tobacco smoke filter (tobacco filter rod). The tobacco smoke filter can be obtained by the per se conventional technology, for example by charging a mold with the fiber material to provide a filter plug or feeding a sheet material to a filter plug wrapping machine.

In order to insure a smooth and uniform passage of the tobacco smoke through the filter plug while channeling is suppressed, the sheet material is preferably creped or embossed beforehand. By the creping or embossing, a filter having an adequate permeability (puffing properties) can be effected. By way of illustration, there can easily be obtained a filter having a satisfactory permeability to tobacco smoke, for example having a pressure drop (puff resistance) of about 200 to 600 mm WG (water gauge or $H_2O$) and preferably about 300 to 500 mm WG in the filter with a length of 10 cm and a diameter of 7.8 mm. Creping can be effected by guiding a sheet material over a pair of creping rollers formed with a multiplicity of grooves running in the direction of advance of the sheet material to form winkles or creases and, to a lesser extent fissures along the path of travel. Embossing can be effected by passing a sheet material over a set of rollers formed with grating-like or random relief pattern having convex and/or concave or pressing a sheet material against a roll formed with such a relief pattern. The permeability of the filter can be adjusted by such creping or embossing.

The pitch and depth of the grooves for creping and the pitch and depth of the embossing pattern can be selected from the range of about 0.3 to 5 mm (e.g. about 0.5 to 5 mm) for pitch and the range of about 0.1 to 2 mm (e.g. about 0.1 to 1 mm) for depth.

In the plug wrapping machine, the creped or embossed sheet material charged into a funnel is cylindrically wrapped up in wrapping paper, glued, and cut to length to provide filter plugs. In this wrapping operation, the creped sheet material is practically wrapped up in a direction transverse or generally perpendicular to the stretching direction of the creases.

In the manufacture of a filter plug, where gluing at the joint of the cylindrical wrapping paper and/or gluing of the cylindrical fiber material and the wrapping paper is required, a water-soluble adhesive such as those mentioned hereinbefore is judiciously chosen so as not to detract from disintegratability.

With such a tobacco smoke filter, a satisfactory aroma, flavor, taste and palatability can be invariably insured. Thus, since the tobacco smoke filter of this invention is made from a partially fibrillated cellulose ester fiber having the specified average fiber diameter and specific surface area, an adequate filtration efficiency and a smoking quality comparable to that obtained with the filter comprising a cellulose acetate tow can be obtained. Furthermore, despite its high dry strength, the filter undergoes easy and rapid disintegration when wetted.

Since the tobacco smoke filter material and filter of this invention comprise a fibrillated cellulose ester fiber having the defined average diameter and specific surface area, they do not adversely affect the smoking quality of tobacco and is highly disintegratable when wetted to reduce the pollution burden on the environment. Moreover, despite its high paper strength, the filter disintegrates itself easily and rapidly when wetted. In addition, this filter remove the harmful components of tobacco with good efficiency and yet without detracting from the aroma and taste of the tobacco smoke.

The process of the present invention provides a material fibrous cellulose ester for the tobacco smoke filter material having the above-mentioned meritorious quality characteristics.

The following examples are intended to illustrate this invention in further detail and should by no means be construed as defining the scope of the invention.

EXAMPLES

In the following examples and comparative examples, the weight and disintegratability of samples were determined as follows.

Water disintegratability (%): Each sample, 0.2 g, was accurately weighed, placed in 500 ml of water in a 1-liter beaker (110 mm in diameter), and stirred with a magnetic stirrer until the height of the vortex center would be equal to ½ of the highest liquid level. After 30 minutes of stirring, the sample was filtered through a 5-mesh metal wire screen. The residue on the screen was dried at 105° C. for 2 hours and weighed. The percentage disintegratability was calculated by means of the following equation for evaluation of water disintegratability.

$$\text{Water disintegratability (\%)}=100\times[1-(B/A)]$$

where A represents the initial weight (g) of the sample and B represents the weight (g) of the dried filtration residue.

Weight ($g/m^2$): Japanese Industrial Standards (JIS) P-8121

The smoking quality evaluation was made as follows. Each sample was fabricated into a filter plug and attached to a cigarette [a commercial cigarette Hi-lite (trade mark), Japan Tobacco Corporation, from which the filter plug had been removed]. A panel of 5 habitual smokers was instructed to evaluate the smoking quality of the sample according to the following scoring criteria.

Organoleptic scoring criteria:

3: Not pungent (hot), with the good taste of tobacco smoke preserved

2: Not pungent (hot) but the taste of tobacco smoke sacrificed to some extent.

1: Pungent or hot

Example 1

Cellulose diacetate (degree of substitution: 2.5) was dissolved in a solvent consisting of 95 parts by weight of acetone and 5 parts by weight of water to prepare a solution of 20 weight % concentration. On the other hand, a coagulation agent solution consisting of acetone and water (10:90 by weight) was prepared and adjusted to a temperature of 20° C.

For the manufacture of a fiber, a device equipped with a cutting means as illustrated in FIGS. 1 and 2 was employed.

The coagulation agent prepared above was passed down the conduit 1a in the direction indicated by the arrowmark in FIG. 1. Simultaneously the cellulose diacetate solution prepared above was fed from the feeder 4 and extruded from the orifices 5 with a diameter of 200 μm of the nozzle means 2 into the coagulation agent while it was cut with the cutter 8 (diameter 8 cm, rotating speed 2,000 rpm), whereupon the cellulose diacetate extrudate was partially fibrillated by the shear force of the cutter and coagulated as it contacted the coagulation agent to provide a cellulose diacetate fiber.

The fiber thus obtained was centrifugally dehydrated and rinsed with warm water at 50° C. to remove the solvent. The apparent diameter of the fiber in wet condition as observed under the microscope was within the range of 100 to 200 μm. The fiber was then immersed in boiling water at 100° C. for 30 minutes, at the end of which time it was dehydrated (fiber A).

When this fiber was dried in a hot air current at 90° C., a soft, flocculent fiber mass was obtained. This constituent fiber had fiber length within the range of about 0.5 to 3 mm and a BET specific surface area of 3 $m^2/g$. The above fibrous mass was molded in a filter plug mold and the resulting molding was wrapped with a wrapping paper to provide a filter plug (25 mm long, 24.5 mm in circumference, 0.23 g/plug). The smoking quality test and disintegratability test showed that this filter plug had an organoleptic score of 2.4 and a water disintegratability of 85%.

Example 2

Fiber A (80 parts by weight) in wet condition as obtained in Example 1 was dispersed in 400,000 parts by weight of water followed by addition of soft wood (conifer) bleached kraft pulp B (20 parts by weight) to prepare an aqueous dispersion (slurry). This dispersion was wet-webbed using a paper machine, dehydrated and dried in a conventional manner to provide a sheet weighing 30 $g/m^2$. The composition of this sheet was identical with the composition of the feed stock. The water disintegratability of the sheet was 72%.

Example 3

The sheet obtained in Example 2 was creped and, without addition of a plasticizer, was mechanically wrapped up at a speed of 100 m/min. to provide a filter plug. The product filter plug was 25 mm long and 24.5 mm in circumference and weighed 0.23 g/plug. The water disintegratability and organoleptic score of this filter plug were 75% and 2.8, respectively.

Example 4

A composition prepared by mixing fiber A according to Example 1, previously dried, with soft wood bleached kraft pulp B in a weight ratio of A/B=80/20 was sprayed against a net by means of an air jet current and, concurrently, a vinyl acetate emulsion was sprayed against the above composition on the net so as to incorporate 5 weight % of vinyl acetate relative to the composition to provide a sheet weighing 35 $g/m^2$. The water disintegratability of this sheet was 69%.

Example 5

The sheet obtained in Example 4 was creped and, without addition of a plasticizer, wrapped up at a speed of 100 m/min. to provide a filter plug (25 mm long, 24.5 mm in circumference, 0.26 g/plug). The water disintegratability and organoleptic score of this filter plug were 65% and 2.6, respectively.

Example 6

A soft wood sulfite pulp (α-cellulose content 92%), as the substrate cellulose, was acetylated in the conventional manner using acetic anhydride as acetylating agent, sulfuric acid as catalyst, and acetic acid as reaction solvent and, then, aged (hydrolyzed) to provide a spinning dope with a composition of cellulose diacetate: acetic acid: water=20:60:20 (by weight). This dope was adjusted to a temperature of 60° C. On the other hand, an aqueous acetic acid solution of 10 weight % concentration was prepared and adjusted to 20° C. for use as the coagulation agent.

For the production of a fiber, a device equipped with cutting means 17 as illustrated in FIGS. 3 and 4 was employed. The coagulation agent was passed down the pipe 11*a* in the direction indicated by the arrowmark in FIG. 3 and the above dope was extruded from the orifices 15 of the nozzle means 12 into the coagulation agent. In this arrangement, the spiral fluid flow created by the impeller type cutting means 17 cut the extrudate before it was coagulated to provide a partially fibrillated cellulose acetate fiber. Meanwhile, the diameter of the impeller was 5 cm and the rotating speed was 3,000 rpm.

This fiber was centrifugally dehydrated and rinsed in warm water at 50° C. to remove the solvent. The apparent diameter of the fiber in wet condition as observed under the microscope was within the range of 50 to 150 μm. This fiber was further immersed in boiling water at 100° C. for 30 minutes, at the end of which time it was dehydrated (fiber C). When this fiber was dried in a hot air current at 90° C., a soft, flocculent fiber mass was obtained.

This dried fiber C (fiber length 0.3 to 2 mm, BET specific surface area 3.8 $m^2/g$) was mixed with the same soft wood bleached kraft pulp B as used in Example 2 in a weight ratio of C/B=60/40 to prepare a composition. This composition, without addition of a plasticizer, was molded in a filter plug mold and the molding was wrapped in wrapping paper to provide a filter plug. The water disintegratability and organoleptic score of this filter plug were 73% and 2.2, respectively.

Example 7

The wet fiber C (60 parts by weight) obtained in Example 6 and the soft wood bleached kraft pulp B (40 parts by weight) were uniformly dispersed in 400,000 parts by weight of water and the dispersion (slurry) was webbed on a paper machine, dehydrated and dried in the per se conventional manner to provide a sheet weighing 30 $g/m^2$. The composition of this sheet was identical with the composition of the feed stock. The water disintegratability of this sheet was 70%.

Example 8

The sheet filter material obtained in Example 7 was roll-creped and, without addition of a plasticizer, wrapped up to provide a filter plug (25 mm long, 24.5 mm in circumference, 0.23 g/plug). The water disintegratability and organoleptic score of this filter plug were 78% and 2.4, respectively.

Comparative Example 1

A filter plug molded from a cellulose diacetate tow in the presence of triacetin was determined for water disintegratability and evaluated organoleptically. The water disintegratability and organoleptic score of this filter plug were 2% and 2.6, respectively.

Comparative Example 2

Except that soft wood bleached kraft pulp B (100 parts by weight) alone was used, the procedure of Example 7 was repeated to provide a sheet weighing 30 g/m$^2$). The water disintegratability of this sheet was 68%. The sheet was further creped and wrapped up to fabricate a filter plug (25 mm long, 24.5 mm in circumference, 0.23 g/plug). The water disintegratability and organoleptic score of this filter plug were 74% and 1.4, respectively.

What is claimed is:

1. A tobacco smoke filter material comprising a fibrillated cellulose ester fiber having an average diameter of 15 to 250 μm and a BET specific surface area of 0.5 to 4.5 m$^2$/g.

2. A tobacco smoke filter material according to claim 1 wherein said fibrous cellulose ester has been partially fibrillated.

3. A tobacco smoke filter material according to claim 1 which comprises said cellulose ester fiber in a proportion of not less than 20 percent by weight based on the total weight of the material.

4. A tobacco smoke filter material according to claim 1 wherein the cellulose ester is an ester of cellulose with an organic acid containing 2 to 4 carbon atoms.

5. A tobacco smoke filter material according to claim 1 wherein the cellulose ester is cellulose acetate.

6. A tobacco smoke filter material according to claim 1 wherein said fibrous cellulose ester has a fiber length of 0.1 to 10 mm.

7. A tobacco smoke filter material according to claim 1 which further comprises natural or regenerated cellulose.

8. A tobacco smoke filter material according to claim 7 wherein the ratio of said fibrous cellulose ester to said natural or regenerated cellulose is 98/2 to 20/80 (by weight).

9. A tobacco smoke filter material according to claim 7, wherein said natural or regenerated fiber is a wood pulp or linter pulp.

10. A tobacco smoke filter material according to claims 1 which is in the form of a sheet having a web structure.

11. A tobacco smoke filter material according to claim 10 which has been creped or embossed.

12. A tobacco smoke filter material comprising a fibrous cellulose acetate having an average degree of acetylation of 29 through 62 percent in a proportion of not less than 40 percent by weight based on the total weight of the material, said cellulose acetate fiber having been partially fibrillated and having an average diameter of 20 to 200 μm and a BET specific surface area of 0.5 to 4 m$^2$/g.

13. A tobacco smoke filter which comprises the tobacco smoke filter material as claimed in claim 1.

* * * * *